US007571705B2

(12) United States Patent
Inaba

(10) Patent No.: US 7,571,705 B2
(45) Date of Patent: Aug. 11, 2009

(54) LUBRICATION DEVICE FOR ENGINE AND OUTBOARD ENGINE SYSTEM

(75) Inventor: Takeshi Inaba, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 132 days.

(21) Appl. No.: 11/902,702

(22) Filed: Sep. 25, 2007

(65) Prior Publication Data

US 2008/0078352 A1 Apr. 3, 2008

(30) Foreign Application Priority Data

Sep. 29, 2006 (JP) ..... 2006-269346
Sep. 29, 2006 (JP) ..... 2006-269347

(51) Int. Cl.
*F01M 11/03* (2006.01)
*F01M 5/00* (2006.01)

(52) U.S. Cl. ..... 123/196 A; 123/196 AB; 123/196 W; 440/88 L; 440/88 C

(58) Field of Classification Search ..... 123/41.31, 123/196 A, 196 AB, 196 W, 195 C, 195 P; 440/88 L, 88 C
See application file for complete search history.

(56) References Cited

U.S. PATENT DOCUMENTS

| | | | | |
|---|---|---|---|---|
| 4,498,875 | A * | 2/1985 | Watanabe | 440/88 L |
| 5,037,340 | A * | 8/1991 | Shibata | 440/88 L |
| 6,039,618 | A * | 3/2000 | Hiraoka et al. | 440/89 R |
| 6,189,501 | B1 * | 2/2001 | Fujii et al. | 123/195 C |
| 6,409,557 | B1 * | 6/2002 | Tsunekawa et al. | 440/88 R |
| 7,121,248 | B2 * | 10/2006 | Fukuda et al. | 123/196 W |
| 7,350,497 | B2 * | 4/2008 | Hiraoka et al. | 123/196 R |

FOREIGN PATENT DOCUMENTS

| | | |
|---|---|---|
| JP | 58-183384 | 10/1983 |
| JP | 7-305617 | 11/1995 |

* cited by examiner

*Primary Examiner*—Hai H Huynh
(74) *Attorney, Agent, or Firm*—Arent Fox LLP

(57) ABSTRACT

A lubrication device for an engine, includes: an oil pan which is disposed at a lower portion of an engine and stores lubrication oil; an oil pump which is disposed above the oil pan and driven by the engine; a suction oil passage which guides the oil in the oil pan to a suction port of the oil pump; and a supply oil passage which guides the oil discharged from a discharge port of the oil pump to lubrication parts of the engine. The suction oil passage is divided into an upstream oil passage on a side of the oil pan and a downstream oil passage on a side of the oil pump. A filter net serving as a strainer is sandwiched between the upstream oil passage and the downstream oil passage. Thus, it is possible to provide the light and simply-structured lubrication device for an engine.

6 Claims, 7 Drawing Sheets

LUBRICATION DEVICE FOR ENGINE AND OUTBOARD ENGINE SYSTEM

RELATED APPLICATION DATA

The present invention is based upon Japanese priority application Nos. 2006-269346 and 2006-269347, which are hereby incorporated in their entirety herein by reference.

BACKGROUND OF THE INVENTION

1. Field of the Invention

The present invention relates to an improvement of a lubrication device for an engine and an outboard engine system, comprising: an oil pan which is disposed at a lower portion of an engine and stores lubrication oil; an oil pump which is disposed above the oil pan and driven by the engine; a suction oil passage which guides the oil in the oil pan to a suction port of the oil pump; a supply oil passage which guides the oil discharged from a discharge port of the oil pump to lubrication parts of the engine; and a strainer which filters the oil sucked from the oil pan by the oil pump.

2. Description of the Related Art

Such a lubrication device for an engine is known as disclosed in Japanese Patent Application Laid-open No. 7-305617 and Japanese Patent Application Laid-open No. 58-183384.

In the conventional lubrication device for an engine, a strainer is mounted to a lower end of a suction pipe disposed in an oil pan. In this device, because the strainer comprises a strainer case directly connected to an opening at the lower end of the suction pipe, and a filter net provided so as to extend in the strainer case, the strainer is heavy and easily swings along with the suction pipe with its own inertia force. Thus, in order to prevent the swing, the suction pipe is supported by a stay extending from an inner wall of the oil pan. In this way, the conventional device has a large weight and a complicated structure.

Further, in the conventional lubrication device for an engine and an outboard engine system, a cooling water passage of the engine is disposed in a central portion of the oil pan so as to pass through the oil pan so that cooling water cools the oil stored in the oil pan. However, in order to cool the entire oil stored in the oil pan with the cooling water of the engine, a large amount of cooling water is required, leading to an extremely low cooling efficiency.

SUMMARY OF THE INVENTION

The present invention has been achieved in view of the above-described circumstances. The present invention has a first object to provide a light and simply-structured lubrication device for an engine. Also, the present invention has a second object to provide a lubrication device for an engine and an outboard engine system in which a suction oil passage for guiding oil in an oil pan to a suction port of an oil pump is cooled with cooling water of the engine, thereby efficiently cooling the oil to be supplied to lubrication parts of the engine.

In order to achieve the first object, according to a first feature of the present invention, there is provided a lubrication device for an engine, comprising: an oil pan which is disposed at a lower portion of an engine and stores lubrication oil; an oil pump which is disposed above the oil pan and driven by the engine; a suction oil passage which guides the oil in the oil pan to a suction port of the oil pump; a supply oil passage which guides the oil discharged from a discharge port of the oil pump to lubrication parts of the engine; and a strainer which filters the oil sucked from the oil pan by the oil pump, wherein the suction oil passage is divided into an upstream oil passage on a side of the oil pan and a downstream oil passage on a side of the oil pump, and a filter net serving as the strainer is sandwiched between the upstream oil passage and the downstream oil passage.

With the first feature of the present invention, the filter net which exerts a strainer function is sandwiched between the upstream oil passage and the downstream oil passage of the suction oil passage. Therefore, a strainer case is not required unlike the case of the conventional device, thereby contributing to reduction in weight of the lubrication device.

According to a second feature of the present invention, in addition to the first feature, the upstream oil passage is integrally formed in a sidewall of the oil pan.

With the second feature of the present invention, the upstream oil passage of the suction oil passage is integrally formed in the sidewall of the oil pan. Therefore, a stay is not required for supporting the suction pipe unlike the case of the conventional device, thereby further contributing to reduction in weight of the lubrication device.

According to a third feature of the present invention, in addition to the second feature, the downstream oil passage is provided in a case member which is joined to an upper end surface of the oil pan via a gasket so as to support the oil pan, and the filter net is connected to the gasket. The case member corresponds to a mount case 16 in an embodiment of the present invention which will be described later.

With the third feature of the present invention, the filter net is integrally connected to the gasket interposed between the joint surfaces of the case member and the oil pan. Therefore, the support structure of the filter net is simplified and becomes reliable, thereby contributing to reduction in cost of the lubrication device.

In order to achieve the second object, according to a fourth feature of the present invention, there is provided a lubrication device for an engine, comprising: an oil pan which is disposed at a lower portion of an engine and stores lubrication oil; an oil pump which is disposed above the oil pan and driven by the engine; a suction oil passage which guides the oil in the oil pan to a suction port of the oil pump; and a supply oil passage which guides oil discharged from a discharge port of the oil pump to lubrication parts of the engine, wherein at least a part of a cooling water passage for guiding cooling water supplied to the engine is disposed adjacent to at least a part of the suction oil passage via a common partition wall. The part of the cooling water passage corresponds to a cooling chamber inlet chamber 26 in the embodiment of the present invention which will be described later.

With the fourth feature of the present invention, the oil with a limited flow rate which flows out of the oil pan and sucked by the oil pump is cooled by the cooling water flowing through the cooling water passage, thereby improving the oil cooling efficiency. Further, the thus-cooled oil performs cooling of the engine as well as lubrication of the engine, thereby contributing to improvement of the durability of the engine.

According to a fifth feature of the present invention, in addition to the fourth feature, at least an upstream oil passage of the suction oil passage is formed in one sidewall of the oil pan, and at least the part of the cooling water passage is integrally connected to the oil pan so that the part of the cooling water passage is adjacent to the upstream oil passage via the common partition wall.

With the fifth feature of the present invention, at least the upstream oil passage of the suction oil passage is formed in one sidewall of the oil pan, and at least a part of the cooling water passage is integrally connected to the oil pan so that the part of the cooling water passage is adjacent to the upstream oil passage via the common partition wall. Therefore, it is not required to dispose pipes of the upstream oil passage and the part of the water passage, or a stay for supporting them, thereby simplifying the lubrication device for the engine and reducing its weight. Further, heat transmission from the upstream oil passage to the cooling water passage becomes excellent, thereby effectively cooling the oil flowing to the oil pump.

In order to achieve the second object, according to a sixth feature of the present invention, there is provided a lubrication device for an outboard engine system including a casing which supports a propeller shaft at a lower portion thereof and an engine which is mounted at an upper portion of the casing and has a vertically-arranged crankshaft, the lubrication device comprising: an oil pan which is formed in the casing and stores lubrication oil to be supplied to the engine; an oil pump driven by the engine; a suction oil passage which guides the oil in the oil pan to a suction port of the oil pump; and a supply oil passage which guides oil discharged from a discharge port of the oil pump to lubrication parts of the engine, wherein at least an upstream oil passage of the suction oil passage is formed in one sidewall of the oil pan, and wherein at least a part of a cooling water passage is integrally connected to the oil pan so that the part of the cooling water passage is adjacent to the upstream oil passage via a common partition wall, the cooling water passage guiding cooling water which is taken in from a water intake port in the lower portion of the casing and which is supplied to the engine. The part of the cooling water passage corresponds to the cooling chamber inlet chamber 26 in the embodiment of the present invention which will be described later.

With the sixth feature of the present invention, not only the oil pan but also the upstream oil passage, at least the part of the cooling water passage, and the common partition wall are formed in the casing. Therefore, it is not required to dispose pipes of the upstream oil passage and a part of the water passage, or a stay for supporting them, thereby simplifying the lubrication device for the engine and reducing its weight. Further, the cooing of the oil can be further facilitated by heat dissipation from the oil pan and the upstream oil passage to the casing.

The above and other objects, features and advantages of the invention will become apparent from a preferred embodiment taken in conjunction with the accompanying drawings.

DESCRIPTION OF THE PREFERRED EMBODIMENT

Figure 1:
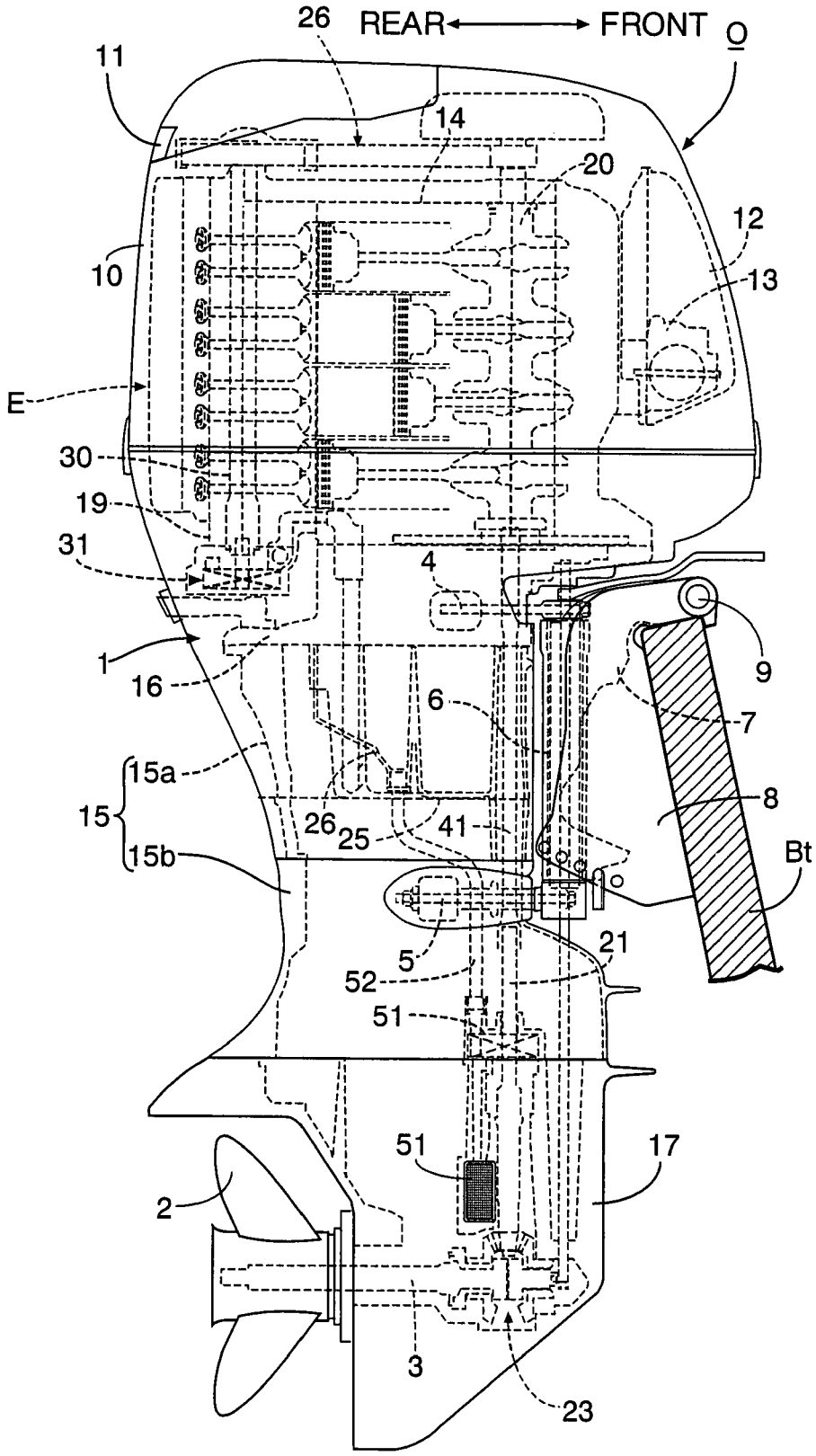
FIG. 1 is side view of an outboard engine system which includes a lubrication device according to an embodiment of the present invention.

Referring to FIG. 1, in an outboard engine system O, a side on a stern bracket 8 is referred to as a front side, and a side opposite thereto is referred to as a rear side. The outboard engine system O includes a casing 1 which has a water-cooled multi-cylinder four-stroke engine E mounted in its upper portion, and supports a propeller shaft 3 at its lower portion. The propeller shaft 3 has a propeller 2 provided at its rear end. A vertically-extending swivel shaft 6 is mounted to the casing 1 via an upper arm 4 and a lower arm 5 so as to situate in front of the casing 1. The swivel shaft 6 is rotatably supported by a swivel case 7 which is coupled to the stern bracket 8 via a horizontally-extending tilt shaft 9. The stern bracket 8 is cramped to a transom Bt of a body of a ship. Therefore, the casing 1 is horizontally rotatable around the swivel shaft 6, and vertically tiltable around the tilt shaft 9.

An engine hood 10 is detachably mounted at an upper end of the casing 1 so as to cover the engine E. An air intake port 11 is provided at a rear end of an upper portion of the engine hood 10. An air intake chamber 12 and a throttle body 13 are disposed in a front portion in the engine hood 10.

The casing 1 includes an extension case 15, a mount case 16 bolt-coupled to an upper end of the extension case 15, and a gear case 17 bolt-coupled to a lower end of the extension case 15. The extension case 15 includes an upper case **15*a* and a lower case 15*b* bolt-coupled to the upper case 15*a*. The mount case 16 is bolt-coupled to an upper end surface of the upper case 15*a* with a gasket held therebetween. The engine E is mounted to the mount case 16 with a crankshaft 20 being vertically arranged and a cylinder block 14 facing rearward. An output shaft 21 connected to the crankshaft 20 is vertically arranged in the extension case 15. A ring gear 22 is secured to a lower end of the crankshaft 20** so as to be driven by a starter device (not shown).

The gear case 17 horizontally supports the propeller shaft 3 having the propeller 2 at its rear end, and houses a forward-reverse shifting gear mechanism 23 connecting the propeller shaft 3 to the output shaft 21.

In operation of the engine E, the power thereof is transmitted from the crankshaft 20 to the output shaft 21, and further to the propeller shaft 3 via the forward-reverse shifting gear mechanism 23, thereby driving the propeller 2. The rotational direction of the propeller 2 is controlled and switched by the forward-reverse shifting gear mechanism 23.

Figure 2:
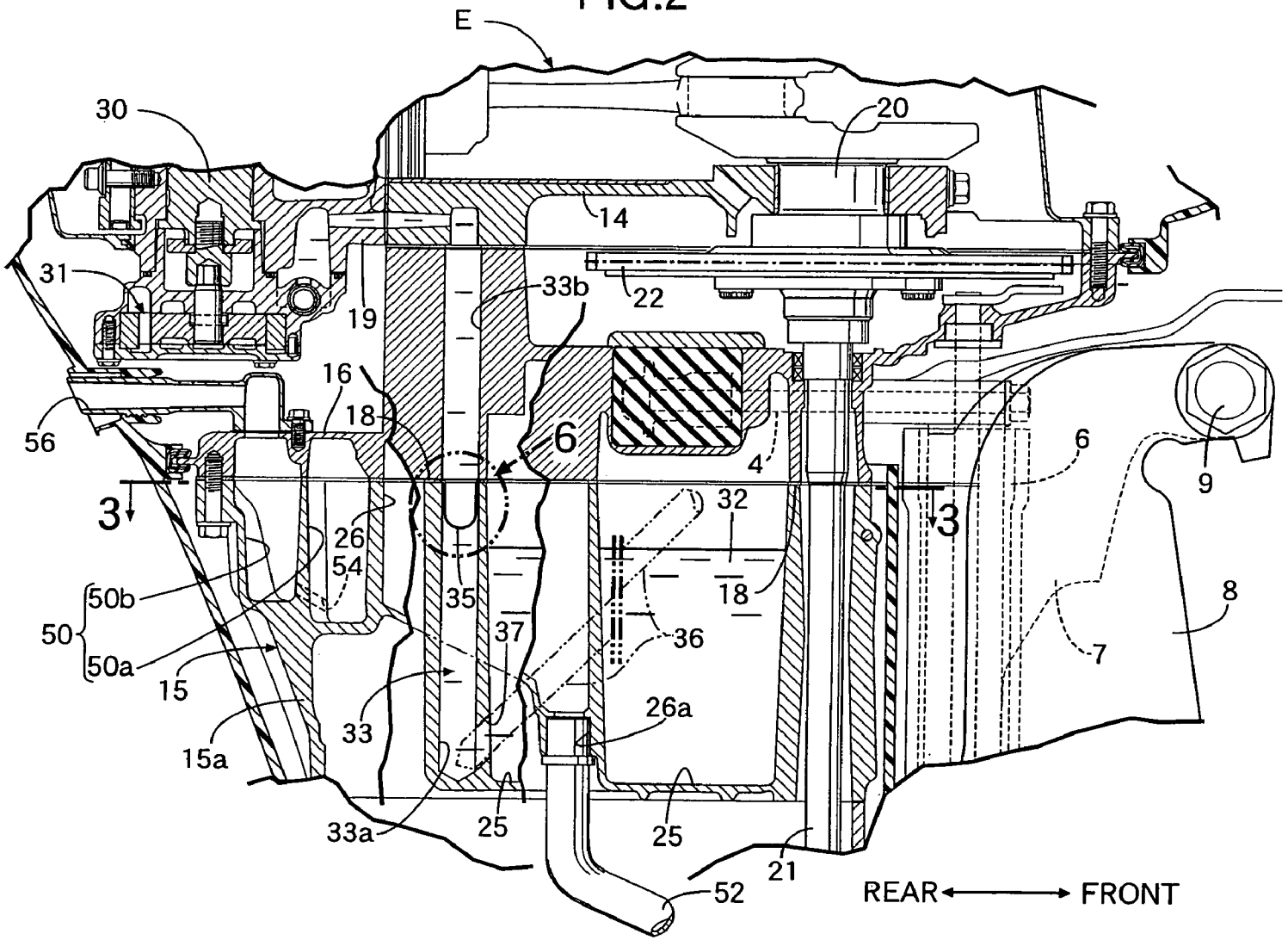
FIG. 2 is a partially enlarged sectional view of FIG. 1.
Figure 3:
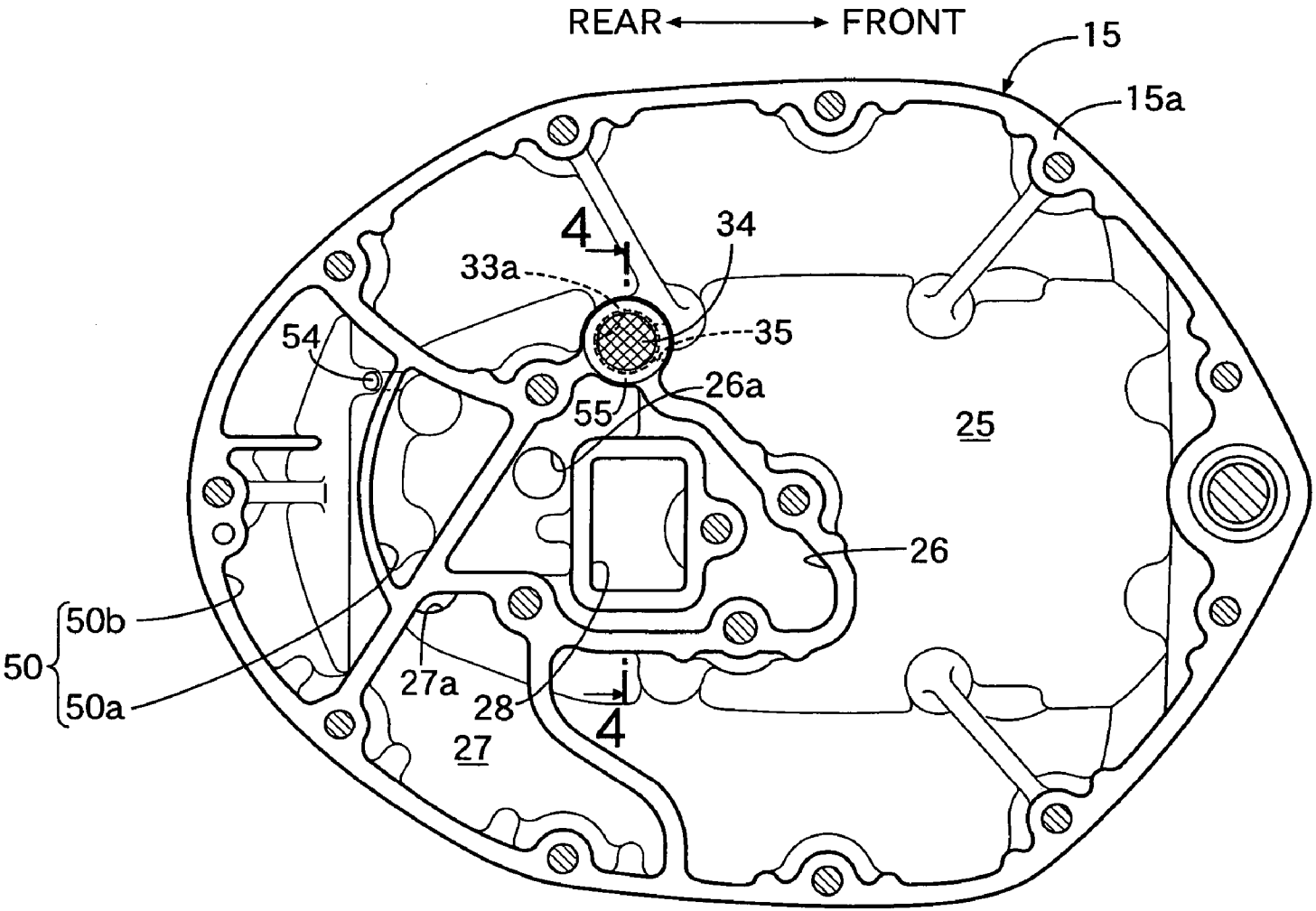
FIG. 3 is a sectional view taken along line 3-3 in FIG. 2.
Figure 4:
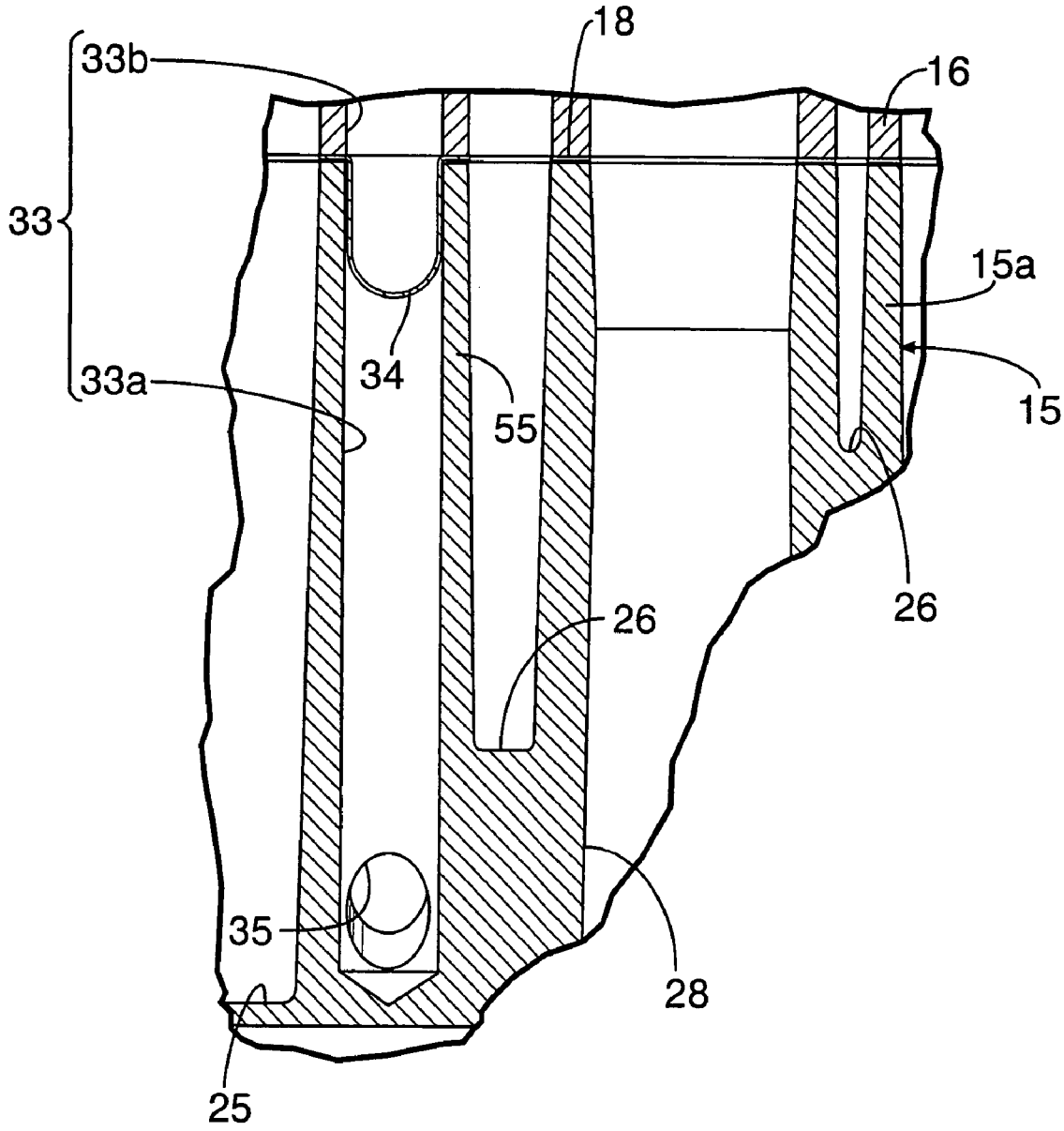
FIG. 4 is a sectional view taken along line 4-4 in FIG. 3.

Referring to FIGS. 2 and 3, integrally formed in the upper case **15*a* of the extension case 15 are an oil pan 25 occupying the front half portion or more of the upper case 15*a*, and a cooling water outlet chamber 27 adjacent to one half of the rear portion of the oil pan 25, and an idle exhaust chamber 50 adjacent to the other half of the rear portion of the oil pan 25. A cooling chamber inlet chamber 26 is integrally formed in a central portion of the upper case 15*a* so as to be interposed between the oil pan 25 and the cooling water outlet chamber 27. An exhaust passage 28 is integrally formed in a central portion of the cooling water inlet chamber 26 so as to vertically pass through the cooling water inlet chamber 26. The idle exhaust chamber 50 is divided into a first chamber 50*a* on a radially inner side, and a second chamber 50*b* on a side outward of the first chamber 50*a*. The chambers 50*a* and 50*b* communicate with each other through a communication hole 54 provided in their lower portions. The first chamber 50*a* communicates with an intermediate portion of the exhaust passage 28 through a passage (not shown). The second chamber 50*b* communicates with an idle exhaust pipe 56 which is mounted to a rear end of the mount case 16. Thus, even when the lower end of the exhaust passage 28 is submerged in the water during idling of the engine E, the exhaust gas of the engine E flows from the intermediate portion of the exhaust passage 28 through the idle exhaust chamber 50 to be smoothly discharged through the idle exhaust pipe 56**.

Now, the lubrication device for the engine E including the oil pan 25 will be described with reference to FIGS. 2 to 7.

As shown in FIG. 2, a valve operating camshaft 30 driven at a reduction ratio of ½ by the crankshaft 20 via a timing transmission device 29 is supported in a cylinder head 19 which is joined to a rear end of a cylinder block 14 such that the valve moving camshaft 30 is parallel with the crankshaft 20. An oil pump 31 driven by the camshaft 30 is mounted to a lower end of the cylinder head 19. A suction oil passage 33 is provided between an intake port of the oil pump 31 and the oil pan 25 so as to guide oil 32 in the oil pan 25 to the oil pump 31.

The suction oil passage 33 comprises an upstream oil passage 33*a* and a downstream oil passage 33*b* divided at the joint surfaces between the oil pan 25 and the mount case 16. A stainless filter net 34 serving as a strainer is sandwiched between opposing portions of the upstream oil passage 33*a* and the downstream oil passage 33*b*.

The upstream oil passage 33*a* of the suction oil passage 33 is integrally formed in one sidewall of the oil pan 25. An upstream end 37 of the upstream oil passage 33*a* is opened to a bottom portion in the oil pan 25 by boring with a rotary tool 36 which is inserted diagonally into an opening in an upper open surface of the oil pan 25. This procedure eliminates the need of providing a closing plug after machining the upstream end 37.

The downstream oil passage 33*b* is integrally formed to extend from the mount case 16 through the cylinder block 14 to the cylinder head 19 to reach the intake port of the oil pump 31.

Figure 5:
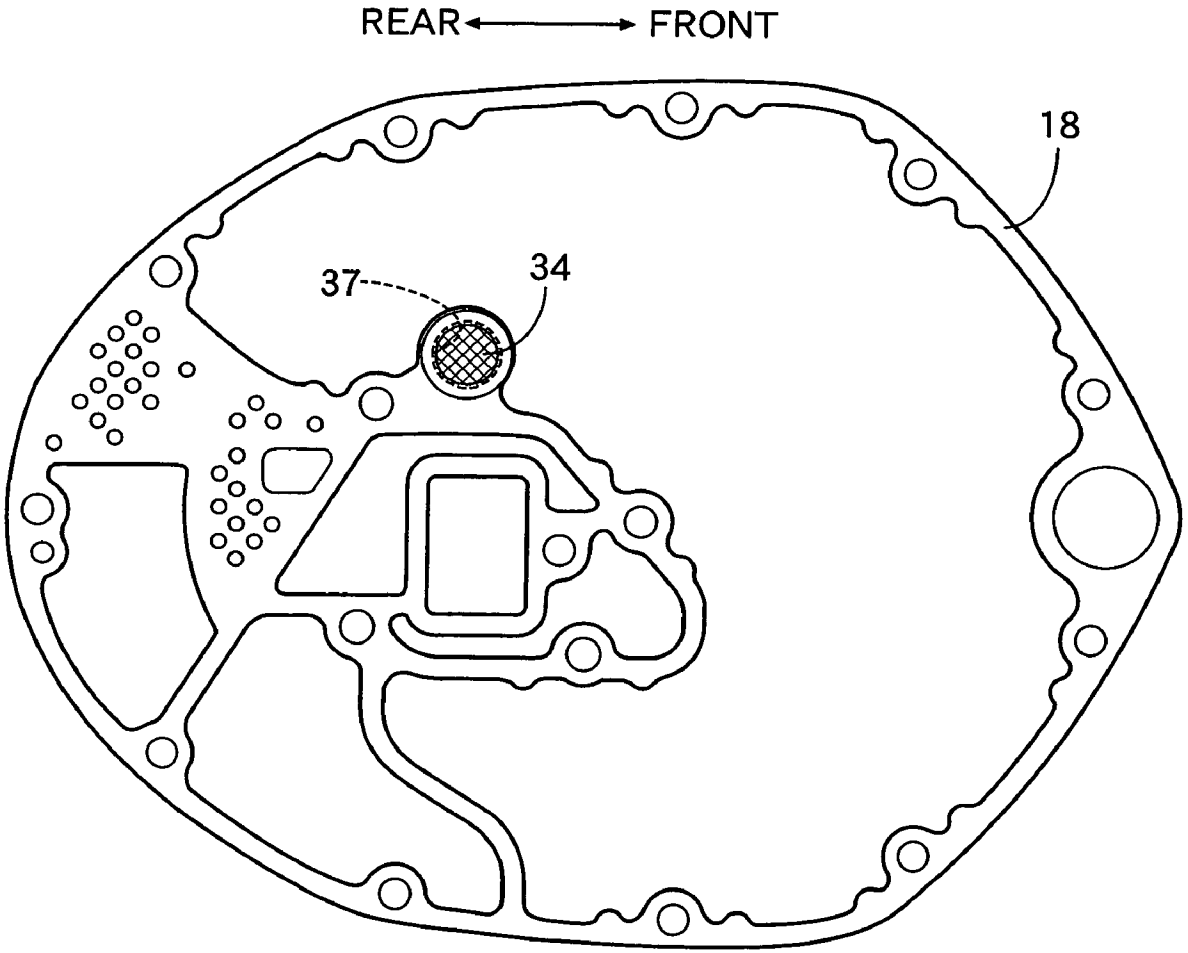
FIG. 5 is a plane view of a gasket.
Figure 6:
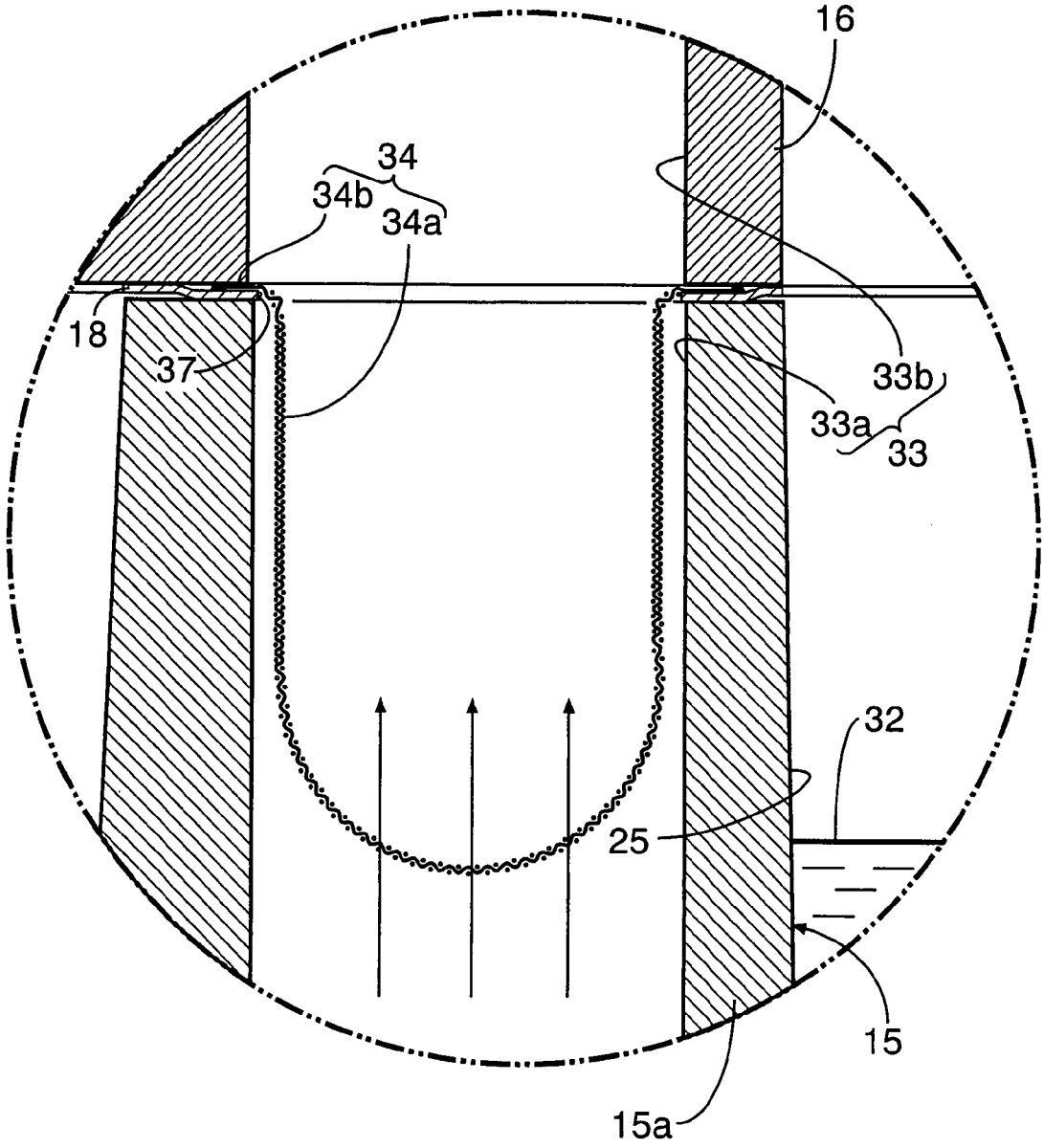
FIG. 6 is an enlarged view of a part 6 in FIG. 2.

Referring to FIGS. 2, 5 and 6, the gasket 18 interposed between the joint surfaces of the upper case 15*a* and the mount case 16 is made of stainless steel, and extends to a position between the joint surfaces of the oil pan 25 and the mount case 16. An opening 35 is provided in the gasket 18 at a portion corresponding to the suction oil passage 33. The filter net 34 comprises a bulged portion 34*a* which is received in a portion extending from an upper end surface of the oil pan 25 to the upstream oil passage 33*a*, and a joint flange 34*b* which radially protrudes from an upper end of the bulged portion 34*a*. The joint flange 34*b* is welded to the periphery of the opening 35 of the gasket 18. The filter net 34 is integrally connected to the gasket 18.

Figure 7:
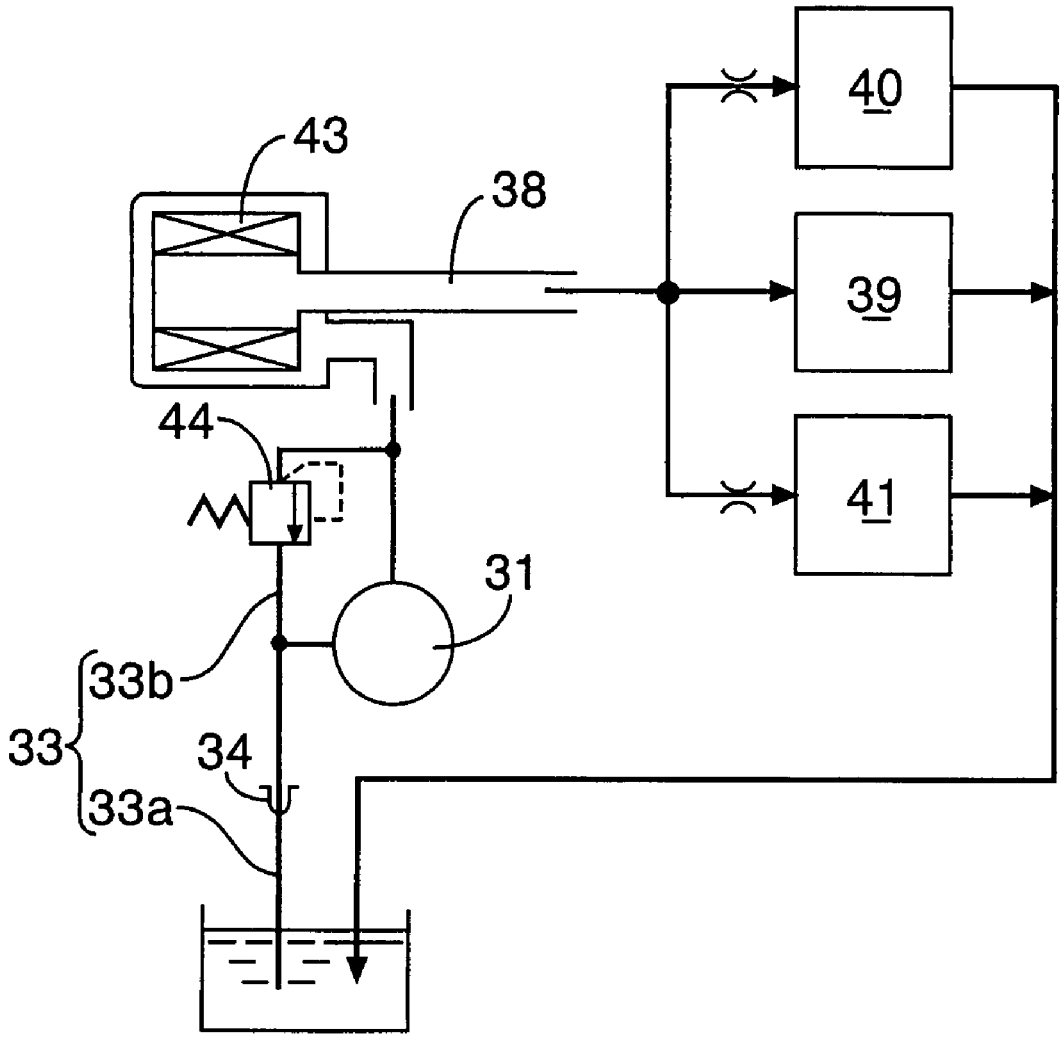
FIG. 7 is a channel diagram of the lubrication device for an engine.

As shown in FIG. 7, a supply oil passage 38 is connected to a discharge port of the oil pump 31. The supply oil passage 38 supplies the oil 32 to a first lubrication part 39 around the crankshaft 20 of the engine E, a second lubrication part 40 around the camshaft 30, and a third lubrication part 41 around the timing transmission device 29. An oil filter 43 and a relief valve 44 are provided on an upstream side of the supply oil passage 38.

Thus, during the operation of the engine E, the oil pump 31 driven by the camshaft 30 sucks the oil 32 in the oil pan 25 through the suction oil passage 33, and discharges the oil 32 into the supply oil passage 38, thereby supplying the oil 32 to the first to third lubrication parts 39 to 41 to lubricate the crankshaft 20, the camshaft 30, the timing transmission device 29 and the other components. The oil having completed lubrication of them is returned by the gravity to the oil pan 25.

In this process, the oil 32 flowing to the oil pump 31 is filtered by the filter net 34 in the suction oil passage 33, and the oil 32 flowing to the first to the third lubrication parts 39 to 41 is further filtered by the oil filter 43 in the supply oil passage 38.

The filter net 34 which exerts the strainer function is sandwiched between the upstream oil passage 33*a* and the downstream oil passage 33*b*, and thus it is not require to dispose a strainer case unlike the case of the conventional strainer, thereby contributing to reduction in weight of the lubrication device.

Particularly because the filter net 34 is integrally connected to the gasket 18 interposed between the oil pan 25 and the mount case 16, the support structure of the filter net 34 is simplified and becomes reliable, thereby contributing to reduction in cost of the lubrication device.

The upstream oil passage 33*a* of the suction oil passage is integrally formed in the sidewall of the oil pan 25, and thus it is not require to dispose a stay for supporting the suction pipe unlike the case of the conventional device, thereby further contributing to the reduction in weight of the lubrication device.

Next, a cooling device of the engine E including the cooling water inlet chamber 26 and the cooling water outlet chamber 27 will be described with reference to FIGS. 1 to 4.

In FIG. 1, a water intake port 51 for taking in external water as cooling water is provided in one sidewall of the gear case 17. On the other hand, as shown in FIG. 2, a bottom wall of the cooling water inlet chamber 26 is conical, and a connection port 26*a* is provided in its lowermost portion. A water suction tube 52 is disposed in the extension case 15 so as to connect the water intake port 51 and the connection port 26*a* to each other. A water pump 53 driven by the output shaft 21 is provided at an intermediate portion of the water suction tube 52 so as to pressurizingly feed the water taken in from the water intake port 51 into the cooling water inlet chamber 26.

The cooling water inlet chamber 26 communicates with the inlet port of a water jacket (not shown) of the engine E so as to guide the cooling water pressurizingly fed from the water pump 53 to the water jacket. The cooling water having completed the cooling the engine E while passing through the water jacket moves into the cooling water outlet chamber 27. The cooling water having moved into the cooing water outlet chamber 27 is released into the extension case 15 through a drainage hole 27*a* in the bottom wall of the cooling water outlet chamber 27.

A downstream end of the exhaust passage 28 passing through the central portion of the cooling water inlet chamber 26 is also opened into the extension case 15, and thus the cooling water is discharged to the outside through a throughhole provided in the central portion of the propeller 2, together with the exhaust gas discharged from the exhaust passage 28.

If the connection port 26*a* is disposed on the front side in the bottom portion of the cooling water inlet chamber 26, the residual water in the cooling water inlet chamber 26 is more reliably discharged into the connection port 26*a* when the outboard engine system O is brought into a forward tilt-up state after stopping the operation of the engine E.

The cooling water inlet chamber 26, the oil pan 25 and the upstream oil passage 33*a* of the suction oil passage 33 are integrally formed in the upper case 15*a* of the extension case 15. The cooling water inlet chamber 26 and the upstream oil passage 33*a* are disposed to be adjacent to each other with a common partition wall 16*a* integral with the upper case 15*a* therebetween.

Thus, the cooling water in the cooling water inlet chamber 26 cools the oil with a limited flow rate which flows out of the oil pan 25 and sucked by the oil pump 31, thereby improving the oil cooling efficiency. Further, the thus-cooled oil performs cooling of the first to the third lubrication parts 39 to 41 of the engine as well as lubrication thereof, thereby contributing to improvement of the durability of the engine E.

In this device, the oil pan 25, the upstream oil passage 33*a* of the suction oil passage 33, the cooling water inlet chamber 26, and the common partition wall 55 between the upstream oil passage 33*a* and the cooling water inlet chamber 26 are integrally formed in the upper case 15*a* of the extension case 15. Therefore, it is not required to dispose pipes of the upstream oil passage 33*a* and the part of the water passage, or a stay for supporting them, thereby simplifying the lubrication device and reducing its weight, and thus simplifying the outboard engine system O and reducing its weight. Further, the heat dissipation from the oil pan 25 and the upstream oil passage 33*a* to the extension case 15 becomes excellent, thereby further facilitating the cooling of the oil.

The embodiment of the present invention has been described above, but various changes in design may be made without departing from the subject matter of the present invention.

What is claimed is:

1. A lubrication device for an engine, comprising:

an oil pan which is disposed at a lower portion of an engine and stores lubrication oil;

an oil pump which is disposed above the oil pan and driven by the engine;

a suction oil passage which guides the oil in the oil pan to a suction port of the oil pump;

a supply oil passage which guides the oil discharged from a discharge port of the oil pump to lubrication parts of the engine; and a strainer which filters the oil sucked from the oil pan by the oil pump, wherein the suction oil passage is divided into an upstream oil passage on a side of the oil pan and a downstream oil passage on a side of the oil pump, and a filter net serving as the strainer is sandwiched between the upstream oil passage and the downstream oil passage.

2. The lubrication device for an engine according to claim 1, wherein the upstream oil passage is integrally formed in a sidewall of the oil pan.

3. The lubrication device for an engine according to claim 2, wherein the downstream oil passage is provided in a case member which is joined to an upper end surface of the oil pan via a gasket so as to support the oil pan, and the filter net is connected to the gasket.

4. A lubrication device for an engine, comprising:

an oil pan which is disposed at a lower portion of an engine and stores lubrication oil;

an oil pump which is disposed above the oil pan and driven by the engine;

a suction oil passage which guides the oil in the oil pan to a suction port of the oil pump; and a supply oil passage which guides oil discharged from a discharge port of the oil pump to lubrication parts of the engine, wherein at least a part of a cooling water passage for guiding cooling water supplied to the engine is disposed adjacent to at least a part of the suction oil passage via a common partition wall.

5. The lubrication device for an engine according to claim 4, wherein at least an upstream oil passage of the suction oil passage is formed in one sidewall of the oil pan, and at least the part of the cooling water passage is integrally connected to the oil pan so that the part of the cooling water passage is adjacent to the upstream oil passage via the common partition wall.

6. A lubrication device for an outboard engine system including a casing which supports a propeller shaft at a lower portion thereof and an engine which is mounted at an upper portion of the casing and has a vertically-arranged crankshaft, the lubrication device comprising:

an oil pan which is formed in the casing and stores lubrication oil to be supplied to the engine;

an oil pump driven by the engine;

a suction oil passage which guides the oil in the oil pan to a suction port of the oil pump; and a supply oil passage which guides oil discharged from a discharge port of the oil pump to lubrication parts of the engine, wherein at least an upstream oil passage of the suction oil passage is formed in one sidewall of the oil pan, and wherein at least a part of a cooling water passage is integrally connected to the oil pan so that the part of the cooling water passage is adjacent to the upstream oil passage via a common partition wall, the cooling water passage guiding cooling water which is taken in from a water intake port in the lower portion of the casing and which is supplied to the engine.

* * * * *